US007252279B2

(12) United States Patent
Conibear

(10) Patent No.: US 7,252,279 B2
(45) Date of Patent: Aug. 7, 2007

(54) DOOR MOUNTED BOOK HOLDER

(76) Inventor: Robert Archibald Conibear, 2985C Avery Dr., Palm Springs, CA (US) 92264

( * ) Notice: Subject to any disclaimer, the term of this patent is extended or adjusted under 35 U.S.C. 154(b) by 23 days.

(21) Appl. No.: 11/158,558

(22) Filed: Jun. 21, 2005

(65) Prior Publication Data

US 2006/0284045 A1 Dec. 21, 2006

(51) Int. Cl.
*A47B 97/04* (2006.01)

(52) U.S. Cl. ..... 248/447; 248/460

(58) Field of Classification Search ..... 248/447, 248/447.1, 465.1, 444.1, 450, 462, 460, 441.1, 248/914; 40/611

See application file for complete search history.

(56) References Cited

U.S. PATENT DOCUMENTS

| | | | | |
|---|---|---|---|---|
| 2,490,356 | A * | 12/1949 | Hummel | 248/463 |
| 4,269,381 | A | 5/1981 | Harms | |
| 4,369,948 | A | 1/1983 | Krass et al. | |
| 4,407,523 | A | 10/1983 | Campione | |
| 4,607,817 | A * | 8/1986 | Aquino | 248/459 |
| 5,884,889 | A * | 3/1999 | Crosby | 248/460 |
| 6,019,339 | A * | 2/2000 | Brayford | 248/444.1 |
| 6,439,533 | B2 | 8/2002 | Armstrong | |
| 6,619,609 | B2 | 9/2003 | Cress | |

* cited by examiner

*Primary Examiner*—Ramon O Ramirez

(57) ABSTRACT

The apparatus shown generally in FIG. (1) is a holder attached to and stored at the back of a cabinet door and when deployed will support an object for viewing from the front of the closed door.

15 Claims, 1 Drawing Sheet

DOOR MOUNTED BOOK HOLDER

CROSS REFERENCED TO RELATED APPLICATIONS

Not Applicable

FEDERALLY SPONSORED RESEARCH

Not Applicable

BACKGROUND OF THE INVENTION

1. Field of Invention

The invention relates to a holder for books or other objects.

2. Background of the Invention

There are many cookbook and book holder patents. Most all address the difficulties in use, specifically where can it be situated so that a book can be conveniently read, not interfere with the work area and then easily stored and deployed. Prior art is generally designed for portability, countertop deployment or under cabinet deployment and mounting.

U.S. Pat. No. 4,369,948, KRASS et AL, 25 Jan. 1983 is mounted under a cabinet and deploys downward and over the countertop below interfering with the space below and large books would interfere with the function of the door.

U.S. Pat. No. 6,619,609, CRESS, 16 Sep. 2003 deploys as in KRASS above and has the same limitations plus its wire construction would cover some of the material behind it and it would not support small cards easily.

U.S. Pat. No. 4,269,381, JOHN F. HARMS, 26 May 1981 is a removable device that is supported from the front of the cabinet after opening the door by hooking around the center support of the cabinet. As such the comments for CRESS above apply and the door may not close once the book was in place. Additionally it has to be removed and stored elsewhere.

U.S. Pat. No. 4,407,523, A. Peter Camplone, 4 Oct. 1983 is a counter top supported design.

U.S. Pat. No. 6,439,533, Todd Armstrong, 27 Aug. 2002 is a display cabinet closed on three sides and is wall or vertically mounted in a permanent position.

OBJECTS AND ADVANTAGES

The object of this invention is to provide a device from which a cookbook or any object could be held for optimal viewing, would not interfere with any of the working area and be easily stored and deployed from the same location. This patent application relates to and progresses from the novel mounting feature of the device, namely on the rear or back of a door. From this location, its stored position, it is deployed for use to the front of the door. Thus when stored it does not intrude greatly on the contents inside a cupboard nor when deployed does it intrude on the counter space or working area below. It is generally at eye level in the deployed position and does not impede the function of the door in either deployed or stored position. The device does not limit the size of the item to be held as it is open on three sides or four sides in other configurations and is additionally able to hold single sheets or cards. The door itself is used both structurally and functionally in that the apparatus is attached to it and acts as a back support for held items when deployed. When taken in combination the result is a simple articulated design. Other objects and advantages will become apparent from the Drawings and Specifications.

SUMMARY

The apparatus is a door mounted holder for holding any item such as a cookbook for viewing from the front of a closed door and stored to the back of the door when not in use.

DRAWINGS

DRAWINGS—REFERENCE NUMBERS

Figure 1:
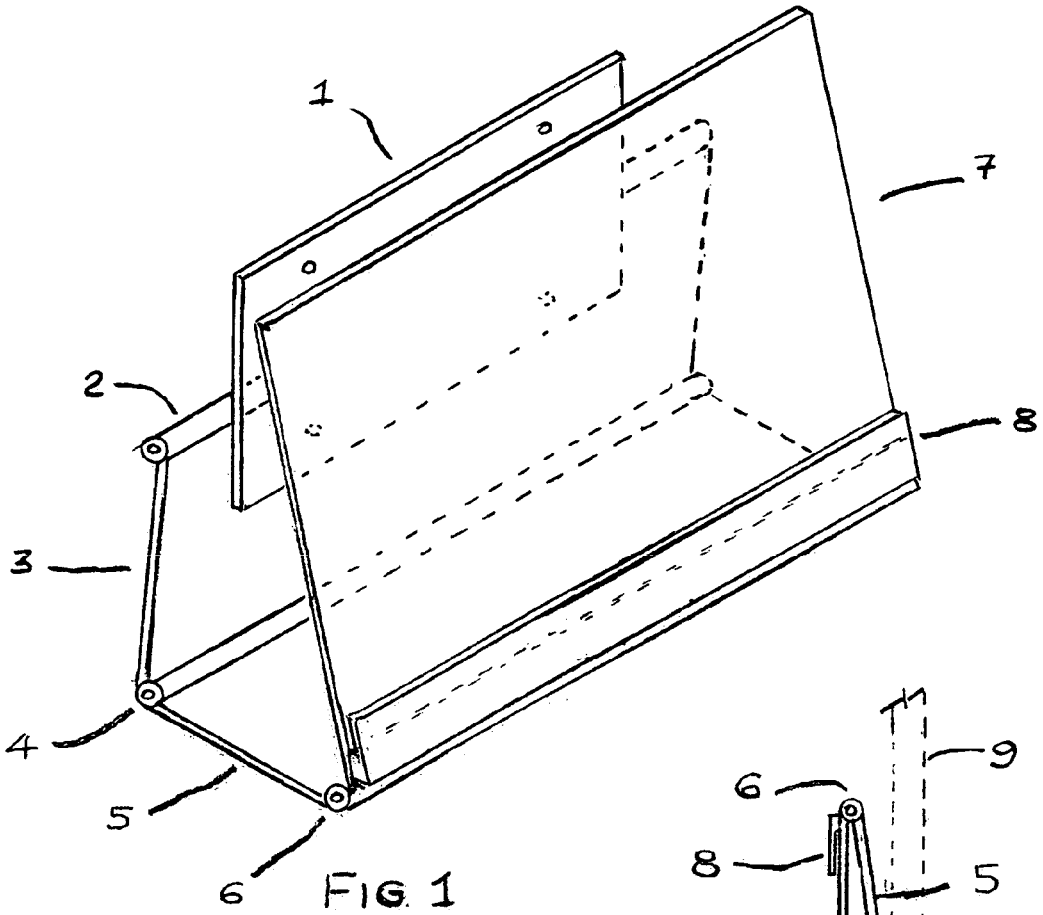
FIG. 1 is a perspective view of the apparatus in the deployed position.

1 Mounting Plate
2 Hinge—locking or non locking type
3 Back support panel
4 Hinge—locking type
5 Bottom support panel
6 Hinge—locking type
7 Front panel
8 Retaining member
9 Door
10 Object being retained

DETAILED DESCRIPTION

The mounting plate 1 is attached to the back or inside of cabinet door 9. A hinge 2 is fixed to mounting plate 1 and connects to the back support panel 3. Hinge 2 could be a locking type hinge. Hinge 2 allows the back support panel 3 to rotate vertically upward in the stored position, FIG. 3 and vertically downward in the deployed position, FIG. 2. Hinge 2 may contain a torsion spring or locking mechanism to hold the apparatus in the stored position. Back support panel 3 may be fixed to door 10 to hold it in either the stored or deployed position. Opposite hinge 2 on the back support panel 3 is hinge 4. Locking hinge 4 connects back support panel 3 with the bottom support panel 5. Hinge 4 allows the bottom support plate to be held vertically upward in the stored position and when rotated to the deployed position holds the bottom support panel 5 in a generally horizontal and locked position. Locking hinge 6 connects the bottom support panel 5 to the front panel 7. Locking hinge 6 allows the front panel 7 to be held vertically down in the stored position and rotated to its locked deployed position. Front panel 7 is transparent.

Figure 2:
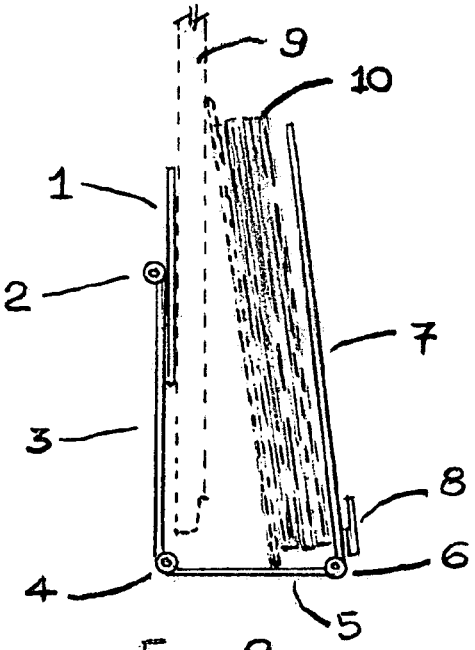
FIG. 2 is an end view of the apparatus in the deployed position.
Figure 3:
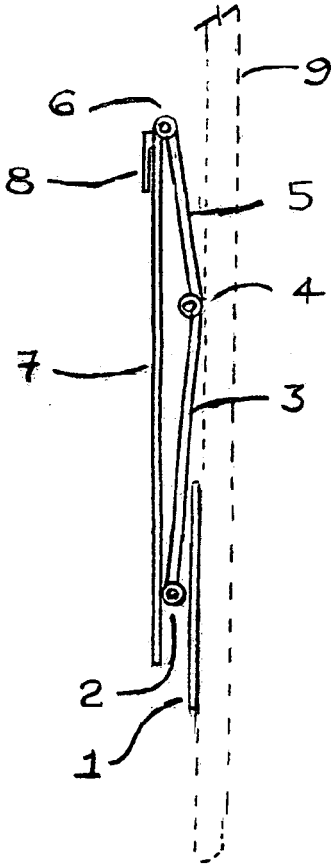
FIG. 3 is an end view of the apparatus in the stored position.

The object to be held 10, a book for instance is placed between front panel 7 and the door 9 when in the deployed position, FIG. 2. Door 9 is also back support for the object being held 10. The bottom support plate 5 carries the weight of the object being held 10. Both the front panel 7 and bottom support panel 5 could be angled off the vertical and horizontal respectively to force the object being held 10 to the front thereby improving the readability of the object being held 10. Front panel 7 and bottom support panel 5 may be configured other than that shown should the shape of object being held 10 so dictate.

The retaining member 8 is attached to front panel 7 in such a manner that a space exists between retaining member 8 and front panel 7. That space will hold a card or a single sheet of paper backed by front panel 7 in the deployed position. Member 8 is transparent. The FIGS. 1, 2 and 3 and the description above is given for one embodiment to hold an object such as a book for viewing. Other embodiments may occur based on different objects to be held but still encompassing features of fixing to one side of a door, storage on that side and deployed to the other side.

ADVANTAGES

From the description above it is shown that the holder is simply deployed from the stored position where it takes up very little space and when deployed does not intrude on work areas below and is at eye level for convenient use. It is not restricted to a book holder only as cards or sheets of paper can also be viewed as well as many other objects, TV's, radios, MP3 Players, PDA's, computers are examples.

CONCLUSIONS

Although the above description includes many specificities those should not be construed as limiting the scope of the invention but as illustration for a singular embodiment from which other embodiments may develop as use dictates. For instance the locking of panels in position may take other forms and means, the holder may deploy from different sides of the door and the panel may take different shapes depending on the configuration of the object to be held. Thus the scope of the invention should be determined by the following Claims and their legal equivalent rather than by the description given.

I claim:

1. A holder for graphic materials such as cookbooks and recipe cards which is mountable to an interior surface of a door of an over-counter cabinet for movement of holder components between a substantially flat storage position adjacent that interior door surface and a usage position in which graphic materials are supportable for viewing adjacent a front surface of the door, the holder comprising first, second, and third links, a mounting element, and pivotable connections serially interconnecting the mounting element and the links for movement relative to each other about spaced parallel hinge axes between the storage and usage positions, the mounting element, the links and the connections being cooperatively defined to hold the first and second links in substantially coplanar relation upwardly from the mounting element in the storage position with the third link adjacent to and substantially parallel to them, and, in the usage position, to hold the first and second links at substantially right angles relative to each other below the mounting element with the second link below the door and with the third link extendible upwardly from the second link adjacent the front surface of the door.

2. A holder according to claim 1 in which the links are defined to enable the door to be closed on the storage position of the holder with minimal intrusion on space behind the door and to be substantially closed in the usage position of the holder.

3. A holder according to claim 1 in which the third link includes features for supporting a book in an opened state.

4. A holder according to claim 3 in which the third link comprises a transparent panel and said features are defined for holding book between the transparent panel and the door front surface plus the means for holding a single sheet of paper such as a recipe card.

5. A holder according to claim 1 in which the links contain the means to fix their position relative to each other and the door in the desired stored or usage position.

6. A holder for graphic materials such as cookbooks and recipe cards which is mountable to an interior surface of a door of an over-counter cabinet for movement of holder components between a substantially flat storage position adjacent that door interior surface and a usage position in which graphic materials are supportable for viewing adjacent a front surface of the door, the holder comprising a mounting element affixable to the door inner surface a selected distance above a bottom edge of the door, a plurality of links including a first end link proximate the mounting element and a second end link distally from the mounting element, and pivotably connections serially interconnecting the mounting element and the links for movement relative to each other about spaced parallel hinge axes between the storage and usage positions, the mounting element, the links and the connections being cooperatively defined to hold the links in a stable substantially flat vertical relation in the storage position and, in the usage position, to stably hold the third end link adjacent the front surface of the door and generally parallel to it.

7. A holder according to claim 6 in which the links are defined to enable the door to be closed on the storage position of the holder with minimal intrusion on space behind the door and to be substantially closed in the usage position of the holder.

8. A holder according to claim 6 in which the third link includes features for supporting a book in an opened state.

9. A holder according to claim 8 in which the third link comprises a transparent panel and said features are defined for holding book between the transparent panel and the door front surface and the means for holding a single sheet of paper such as a recipe card.

10. A holder according to claim 6 in which the links contain the means to fix their position relative to each other and the door in the desired stored or usage position.

11. A holder for graphic materials such as cookbooks and recipe cards which is mounted to an interior surface of a door of an over-counter cabinet for movement of holder components between substantially flat storage position adjacent that door interior surface and a usage position in which graphic materials are supportable for viewing adjacent a front surface of the door, the holder comprising first, second, and third links, a mounting element, and pivotable connections serially interconnecting the mounting element and the links or movement relative to each other about spaced parallel hinge axes between the storage and usage positions the mounting element the links and the connections being cooperatively defined to hold the first and second links in substantially coplanar relation upwardly from the mounting element in the storage position with the third link adjacent to and substantially parallel to them, and to hold the first and second links at substantially right angles relative to each other below the mounting element with the third link extendable upwardly from the second link in the usage position in which the third link is disposable adjacent the front surface of the door and generally parallel to it.

12. A holder according to claim 11 in which the links are defined to enable the door to be closed on the storage position of the holder with minimal intrusion on space behind the door and to be substantially closed in the usage position of the holder.

13. A holder according to claim 11 in which the third link includes features for supporting a book in an opened state.

14. A holder according to claim 13 in which the third link comprises a transparent panel and said features are defined for holding book between the transparent panel and the door front surface and the means for holding a single sheet of paper such as a recipe card.

15. A holder according to claim 11 in which the links contain the means to fix their position relative to each other and the door in the desired stored or usage position.

* * * * *